US010205265B2

(12) United States Patent
Wu et al.

(10) Patent No.: US 10,205,265 B2
(45) Date of Patent: Feb. 12, 2019

(54) PLUG CONNECTOR ASSEMBLY HAVING IMPROVED CONTACTING MODULE STRUCTURE

(71) Applicant: FOXCONN INTERCONNECT TECHNOLOGY LIMITED, Grand Cayman (KY)

(72) Inventors: Jerry Wu, New Taipei, CA (US); Jun Chen, Kunshan (CN); Xiao Fan, Kunshan (CN); Zhi-Yong Zhou, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/817,317

(22) Filed: Nov. 20, 2017

(65) Prior Publication Data

US 2018/0145440 A1 May 24, 2018

(30) Foreign Application Priority Data

Nov. 23, 2016 (CN) ..... 2016 1 1040950

(51) Int. Cl.
*H01R 13/502* (2006.01)
*H01R 13/405* (2006.01)
(Continued)

(52) U.S. Cl.
CPC ..... *H01R 13/502* (2013.01); *H01R 13/405* (2013.01); *H01R 13/6273* (2013.01); *H01R 13/635* (2013.01); *H01R 12/594* (2013.01); *H01R 12/714* (2013.01); *H01R 12/721* (2013.01); *H01R 13/6275* (2013.01); *H01R 13/6581* (2013.01); *H01R 13/6658* (2013.01)

(58) Field of Classification Search
CPC ..... H01R 13/502; H01R 13/405; H01R 13/6273; H01R 13/633; H01R 13/635; H01R 13/62
USPC ..... 439/155, 607, 660
See application file for complete search history.

(56) References Cited

U.S. PATENT DOCUMENTS 7,114,963 B2 10/2006 Shuey et al.
7,175,465 B1 * 2/2007 Tsai ..... H01R 13/6275 439/352

(Continued)

*Primary Examiner* — Tulsidas C Patel
*Assistant Examiner* — Peter G Leigh
(74) *Attorney, Agent, or Firm* — Wei Te Chung; Ming Chieh Chang

(57) ABSTRACT

A plug connector assembly includes a cable and a mating member electrically connected to the cable, the mating member having an insulative housing and a contacting module retained in the insulative housing, the contacting module having a first contacting module unit and a second contacting module unit, the first contacting module unit having plural first contacts arranged along a lateral direction and a first insulative member retaining the first contacts, the second contacting module unit having plural second contacts arranged along the lateral direction and a second insulative member retaining the second contacts, wherein each of the first and second insulative members includes a same engagement structure, through which the first insulative member and the second insulative member are assembled into a whole by interference arrangement and then inserted into the insulative housing together.

20 Claims, 11 Drawing Sheets

(51) Int. Cl.

| | |
|---|---|
| ***H01R 13/627*** | (2006.01) |
| ***H01R 13/635*** | (2006.01) |
| *H01R 12/59* | (2011.01) |
| *H01R 12/71* | (2011.01) |
| *H01R 12/72* | (2011.01) |
| *H01R 13/6581* | (2011.01) |
| *H01R 13/66* | (2006.01) |

(56) References Cited

U.S. PATENT DOCUMENTS

| | | | | |
|---|---|---|---|---|
| 9,444,204 | B2 * | 9/2016 | Yen | H01R 24/78 |
| 9,461,425 | B2 * | 10/2016 | Tamaki | H01R 13/508 |
| 9,917,405 | B2 * | 3/2018 | Ju | H01R 13/6585 |
| 2010/0297885 | A1 * | 11/2010 | Cao | H01R 4/028 439/626 |
| 2015/0288104 | A1 * | 10/2015 | Regnier | H01R 24/62 439/676 |
| 2015/0333460 | A1 * | 11/2015 | Regnier | H01R 24/62 439/676 |
| 2015/0340821 | A1 * | 11/2015 | Yen | H01R 13/6581 439/607.01 |
| 2015/0364865 | A1 * | 12/2015 | Sutter | H01R 24/62 439/345 |
| 2016/0064877 | A1 * | 3/2016 | Tamaki | H01R 13/508 439/676 |
| 2016/0118752 | A1 * | 4/2016 | Guo | H01R 13/6585 439/78 |
| 2016/0315418 | A1 * | 10/2016 | Sutter | H01R 24/62 |
| 2016/0322753 | A1 * | 11/2016 | Cheng | H01R 13/631 |

* cited by examiner

PLUG CONNECTOR ASSEMBLY HAVING IMPROVED CONTACTING MODULE STRUCTURE

BACKGROUND OF THE INVENTION

1. Field of the Invention

The present invention relates generally to a plug connector assembly and more particularly to an improved contacting module structure for easy assembly.

2. Description of Related Arts

U.S. Patent Application Publication No. 2015/0288104, published on Oct. 8, 2015, shows a plug connector assembly including a mating member, a cable electrically connected with the mating member, and an outer case enclosing the mating member and the cable. The mating member includes an insulative housing and a pair of contacting modules assembled in the insulative housing. The contacting modules are inserted into the insulative housing respectively. Thus, the pair of contacting modules needs to be assembled separately and needs to be aligned and installed separately, increasing the assembly process and cost.

An improved contacting module structure in a plug connector assembly is desired.

SUMMARY OF THE INVENTION

An object of the present invention is to provide an improved contacting module having an easy assembling process and a lower cost.

To achieve the above-mentioned object, a plug connector assembly comprises: a cable; and a mating member electrically connected to the cable, the mating member including an insulative housing and a contacting module retained in the insulative housing, the insulative housing including: a mating surface defined on a front end thereof; an opposite mounting surface; a mating slot inwardly extending from the mating surface, and further including a plurality of first contacting slots arranged on a side thereof and a plurality of second contacting slots arranged on another side thereof; and a mounting slot communicating with the mating slot and inwardly extending from the mounting surface for inserting the contacting module, the contacting module including: a first contacting module and a second contacting module, the first contacting module including a plurality of first contacts arranged along a lateral direction and a first insulative member retaining the first contacts, the second contacting module including a plurality of second contacts arranged along the lateral direction and a second insulative member retaining the second contacts; wherein each of the first and second insulative members includes a same engagement structure, through which the first insulative member and the second insulative member are assembled into a whole by interference arrangement and then inserted into the insulative housing together.

DETAILED DESCRIPTION OF THE PREFERRED EMBODIMENT

Figure 1:
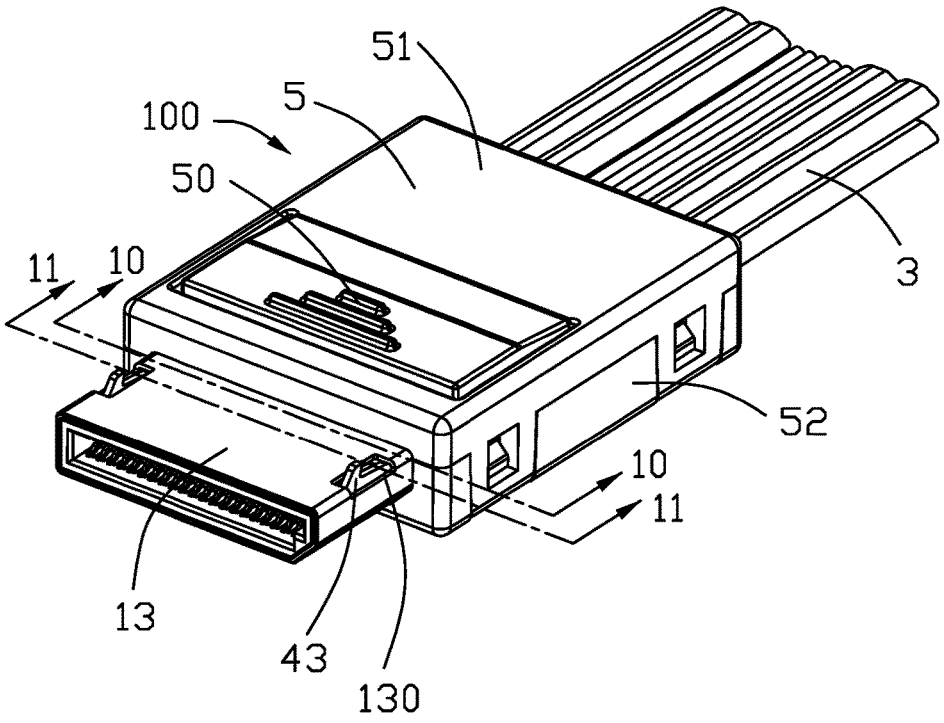
FIG. 1 is a perspective view of a plug connector assembly in accordance with the present invention.
Figure 2:
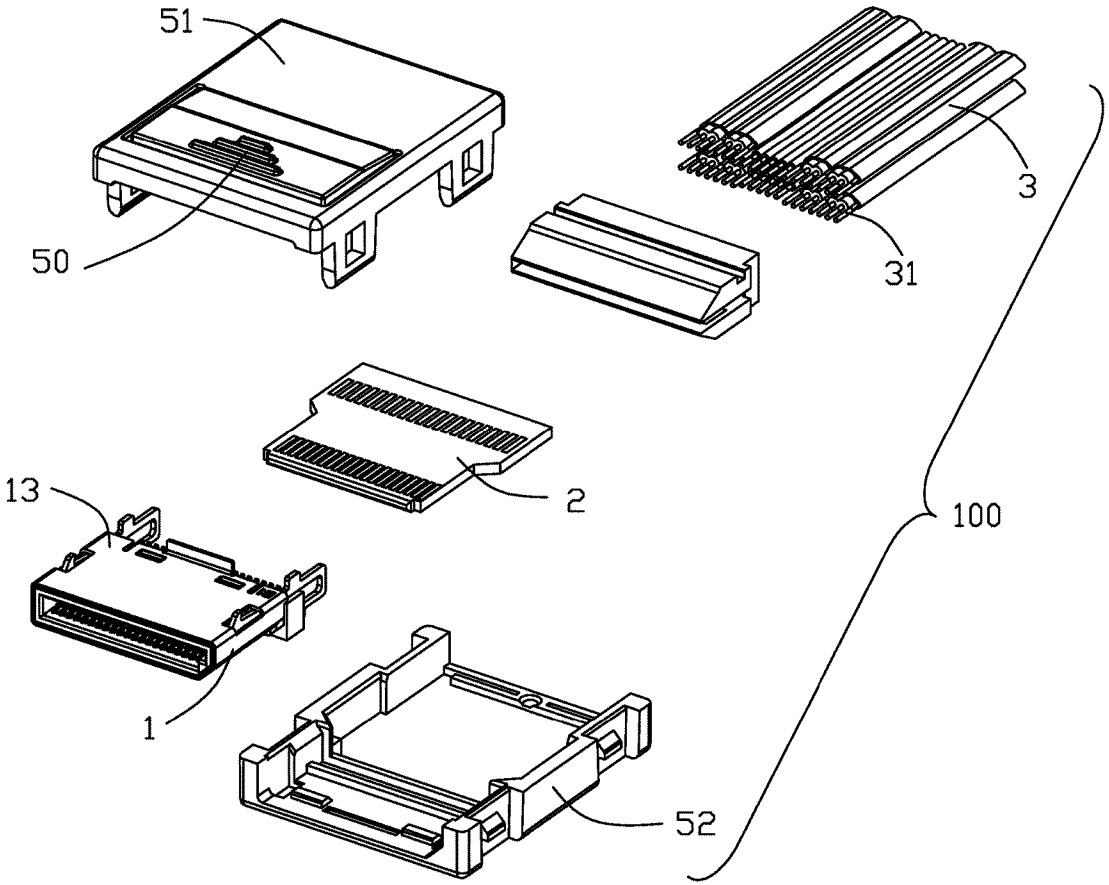
FIG. 2 is an exploded view of the plug connector assembly in FIG. 1.
Figure 3:
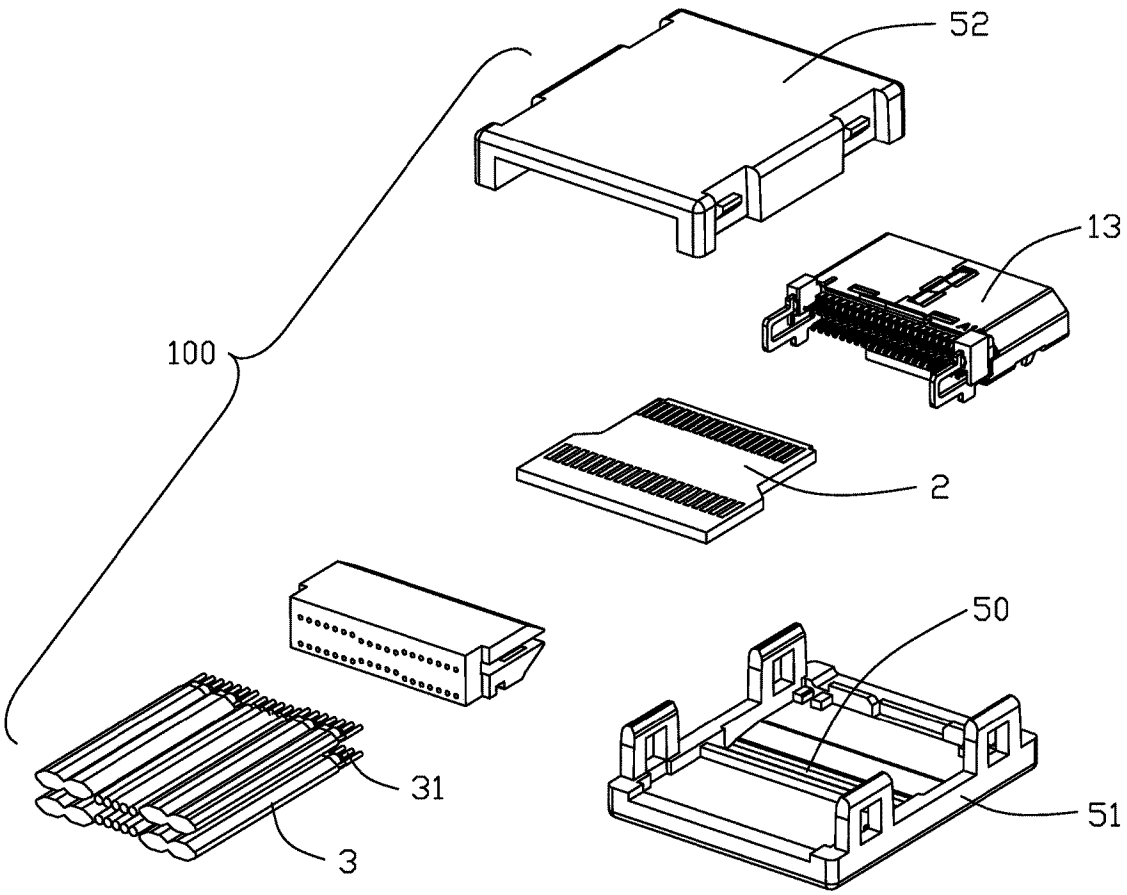
FIG. 3 is an exploded view similar to FIG. 2, but from a different aspect.
Figure 4:
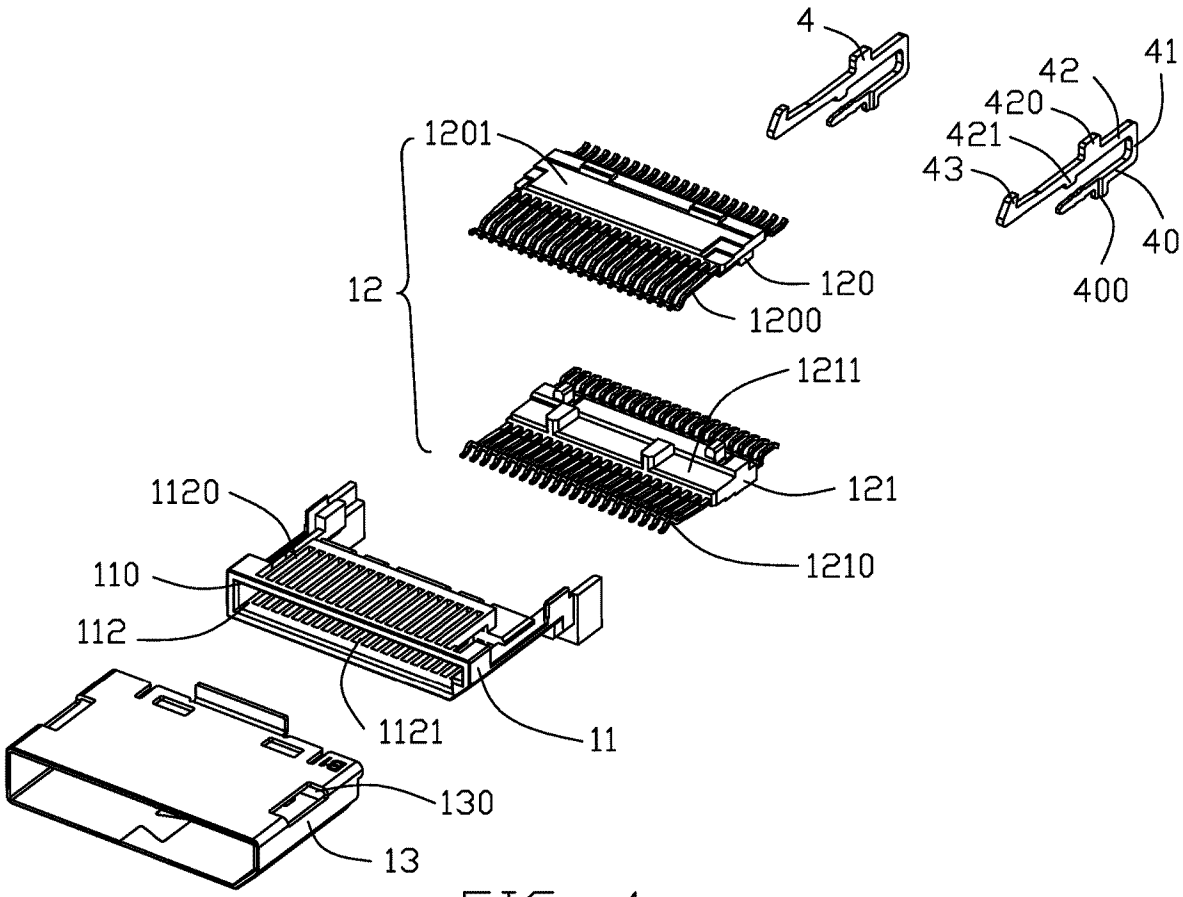
FIG. 4 is an exploded view of the mating member of the plug connector assembly in FIG. 1.
Figure 5:
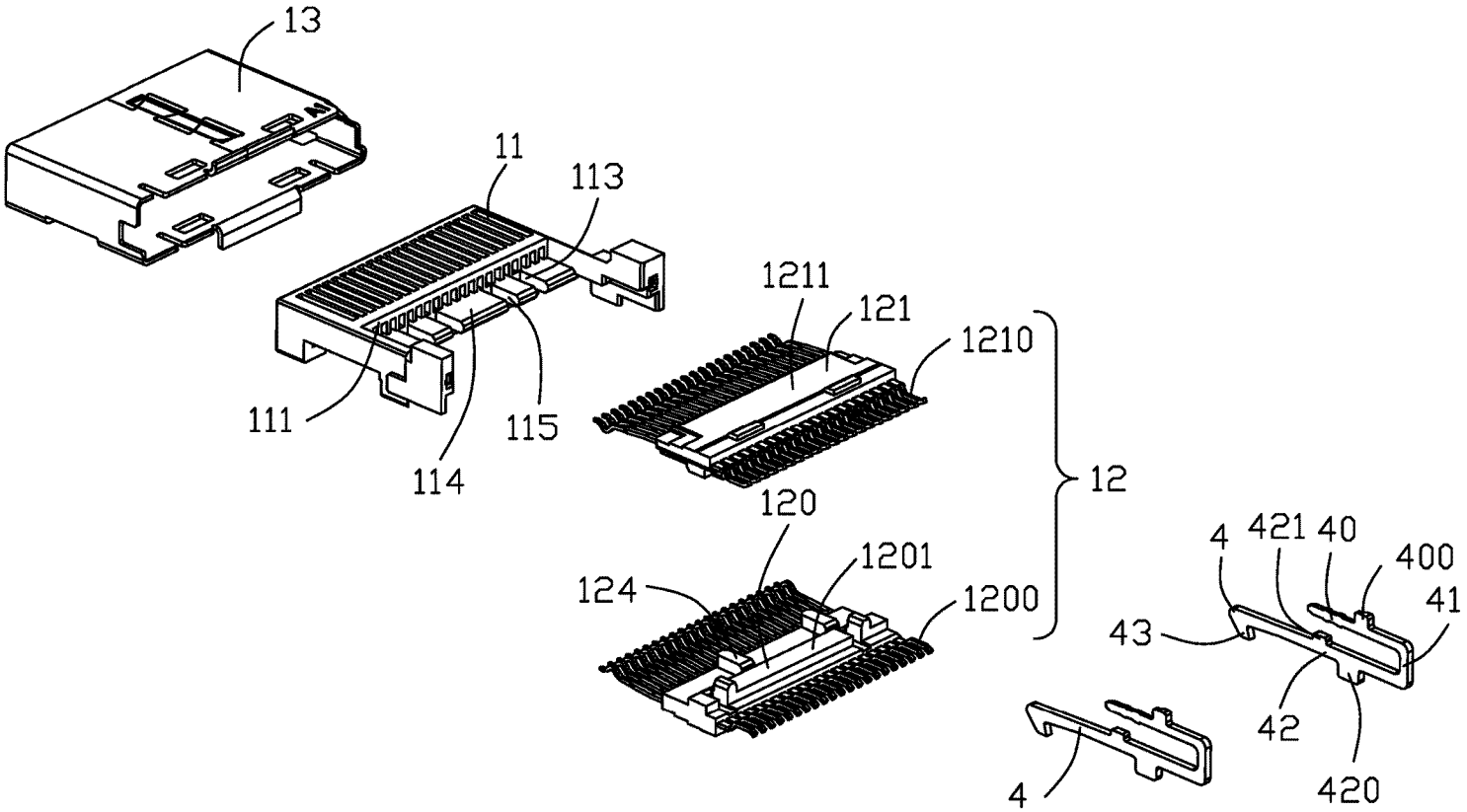
FIG. 5 is an exploded view similar to FIG. 4, but from a different aspect.
Figure 6:
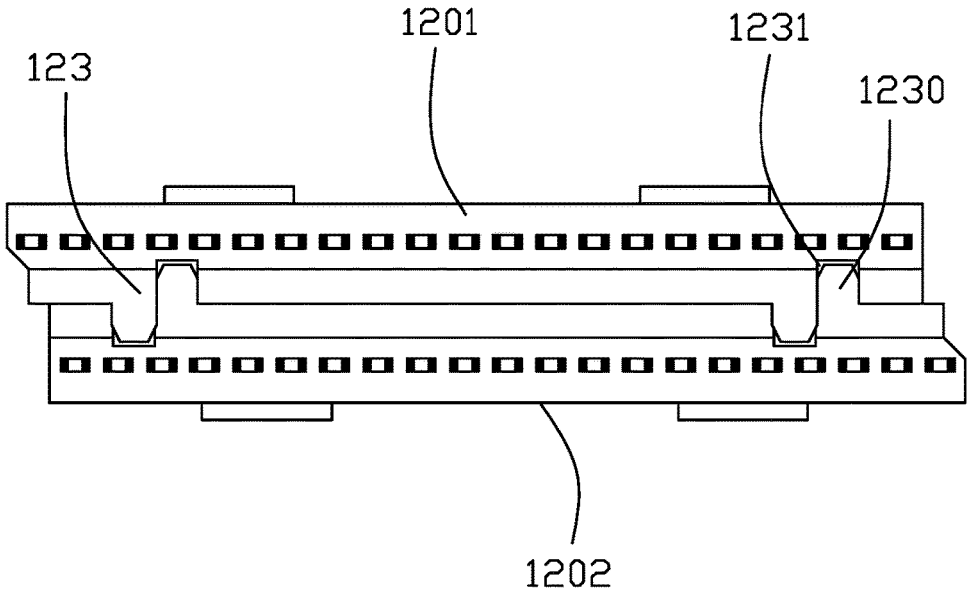
FIG. 6 is a front view of the assembly of the first insulative member and the second insulative member of the plug connector assembly in FIG. 1.
Figure 7:
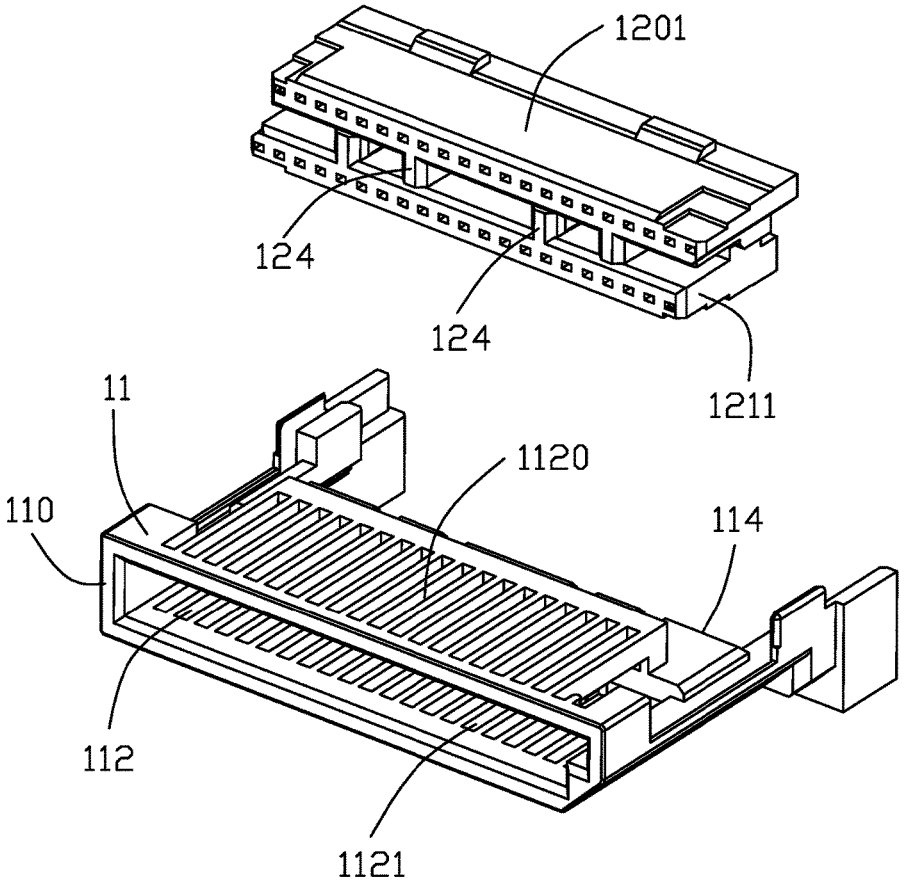
FIG. 7 is a perspective view of the insulative housing, the first insulative member and the second insulative member of the plug connector assembly in FIG. 1.

Referring to FIGS. 1 to 11, a plug connector assembly 100 in accordance with the present invention comprises a mating member 1, a printed circuit board 2 electrically connected to the mating member 1, a cable 3 electrically connected with the printed circuit board 2, a latching member 4 assembled on the mating member 1 for latching with a mating connector and an outer case 5 enclosing the mating member 1 and the cable 3. An end of the printed circuit board 2 is connected to the meting member 1 and another end is connected to the cable 3. The cable 3 is a flat structure and includes a plurality of core wires 31.

Figure 8:
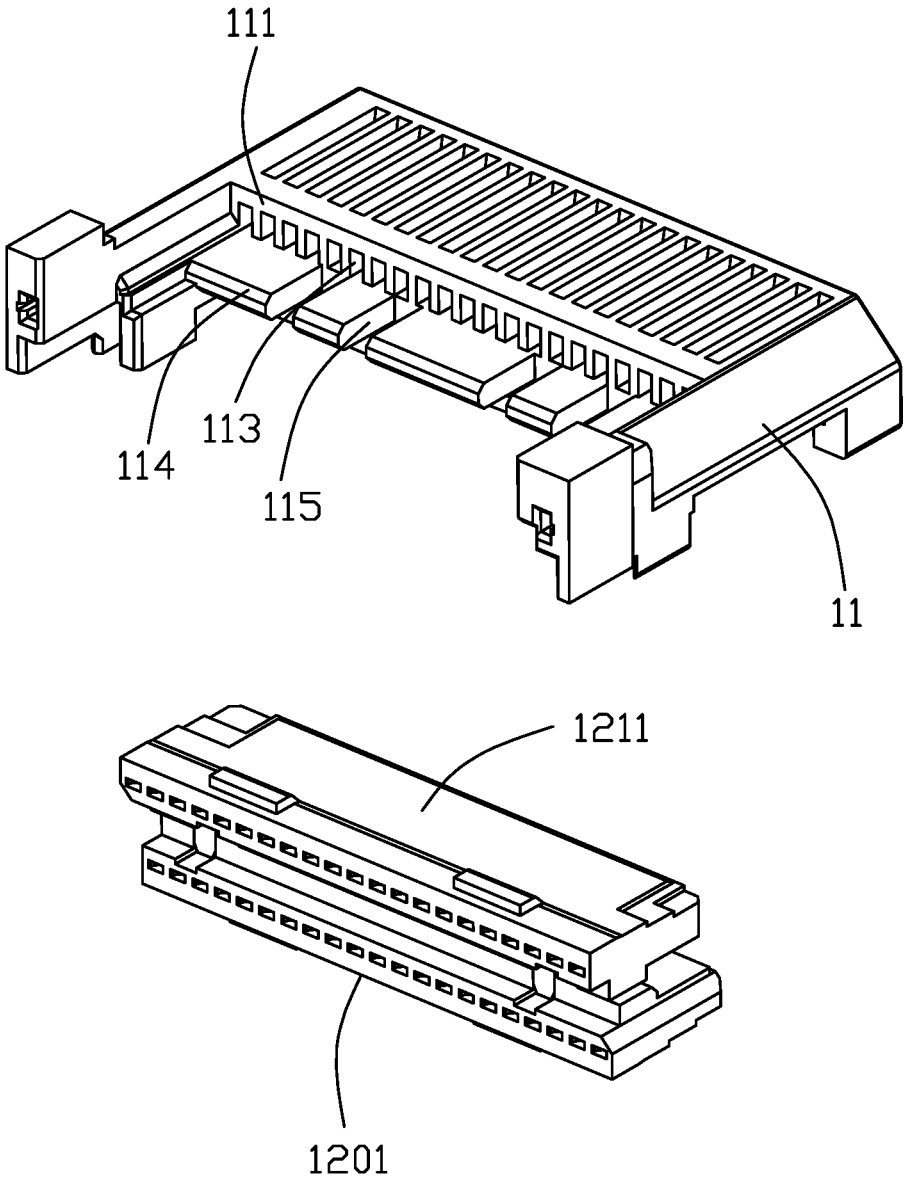
FIG. 8 is a perspective view similar to FIG. 7, but from a different aspect.
Figure 9:
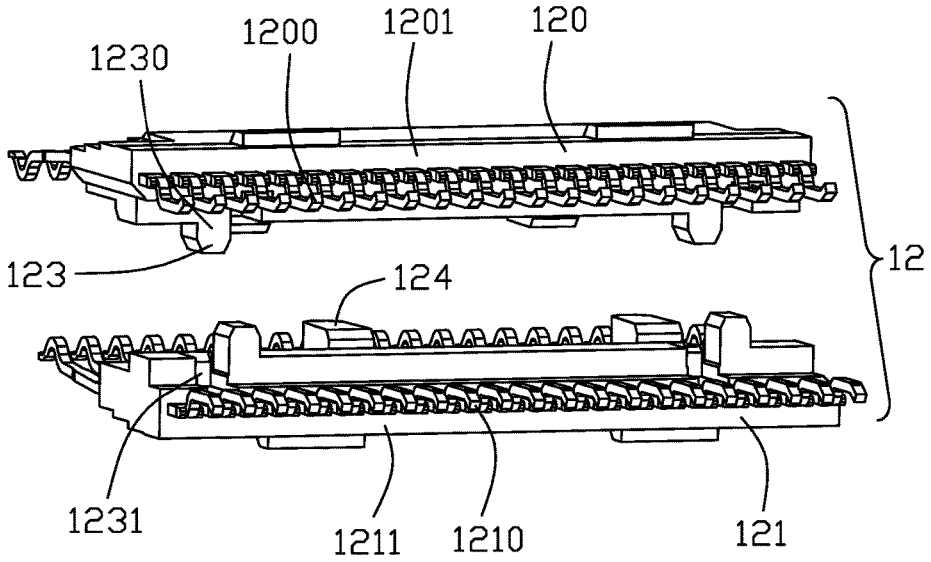
FIG. 9 is a perspective view of the first contacting module and the second contacting module of the plug connector assembly in FIG. 1.
Figure 10:
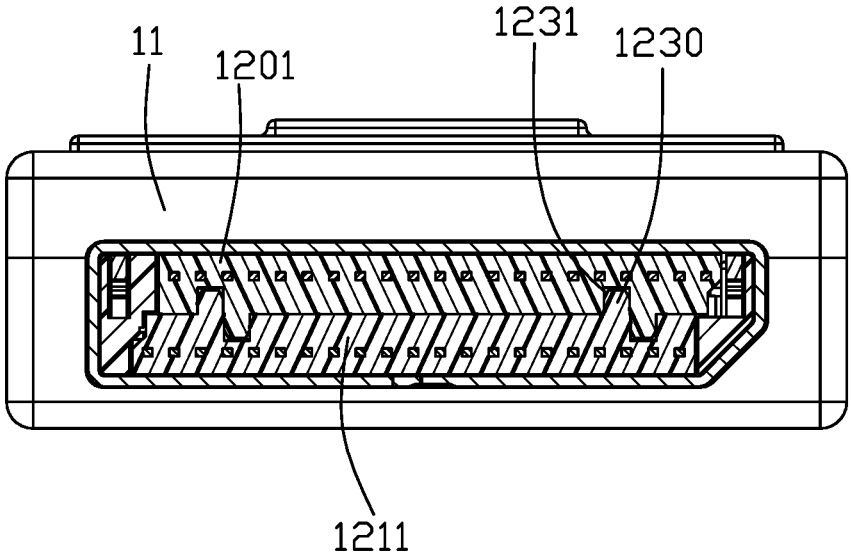
FIG. 10 is a sectional view of the plug connector assembly in FIG. 1, taken along line 10-10.
Figure 11:
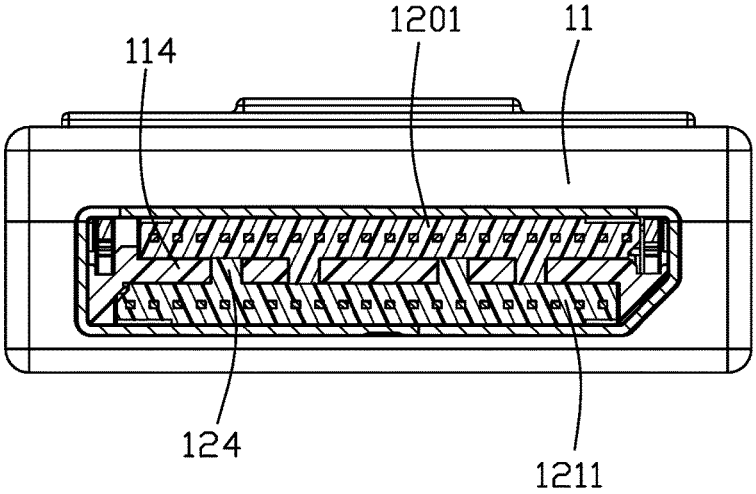
FIG. 11 is a sectional view of the plug connector assembly in FIG. 1, taken along line 11-11.

The mating member 1 includes an insulative housing 11, a contacting module 12 retained in the insulative housing 11 and a metal case 13 enclosing the insulative housing 11. The insulative housing 11 defines a mating surface 111 on a front end thereof, an opposite mounting surface 111, a mating slot 112 inwardly extending from the mating surface 111 and a mounting slot 113 inwardly extending from the mounting surface 111 and communicating with the mating slot 112. The insulative housing 11 further includes a mounting plate 114 defining a plurality of engagement slot 115. The mating slot 112 includes a plurality of first contacting slots 1120 defined on a side thereof for allowing outward deflection of the contact arm of first contact 1200, and a plurality of second contacting slots 1121 defined on another side thereof for allowing outward deflection of the contact arm of the second contact 1210. The contacting module 12 is mounted into the insulative housing 11 from the mounting slot 113. The contacting module 12 includes a first contacting module 120 and a second contacting module 121 assembled to each other along a vertical direction in an opposite manner. The first contacting module 120 includes a plurality of first contacts 1200 laterally spaced with one another in a transverse direction perpendicular to the vertical direction, and a first insulative member 1201 enclosing the first contacts 1200. The second contacting module 121 includes a plurality of second contacts 1210 laterally spaced with one another in the transverse direction and a second insulative member 1211 enclosing the second contacts 1210. Both of the first insulative member 1201 and the second insulative member 1211 define a same engagement structure 123, for intervene to engage the first insulative member 1201 with the second insulative member 1211, to combination as a whole and integrally attached to the insulating housing 11. As shown in FIG. 8, the mounting slot 113 is essentially composed of a plurality of units spaced from one another in the transverse direction for allowing the contact arms (not labeled) of the corresponding first contact 1200 and second contact 1210 to extend therethrough in a front-to-back direction perpendicular to both the vertical direction and the transverse direction. Further referring to FIG. 11, the mounting plate 114, which extends in a horizontal plane, is sandwiched between the first insulative member 1201 and the second insulative member 1211 in the vertical direction.

More specifically, the engagement structure 123 includes a mounting projection 1230 and a mounting hollow 1231. The mounting projection 1230 disposed on the first insulative member 1201 is interference inserted into the corresponding mounting hollow 1231 disposed on the second insulative member 1211, and the mounting projection 1230 disposed on the second insulative member 1211 is interference inserted into the corresponding mounting hollow 1231 disposed on the first insulative member 1201, thus the first contacting module 120 and the second contacting module 121 are fixed and held together. Both of the first insulative member 1201 and the second insulative member 1211 define a pair of spaced engagement structures 123, and the mounting projection 1230 and the mounting hollow 1231 of each engagement structures 123 are connected together.

Both of the first insulative member 1201 and the second insulative member 1211 define a plurality of bumps 124 interference inserted into the corresponding engagement slots 115 of the mounting plate 114, to fix the contacting module 12 on the insulative housing 11. The engagement slots 115 of the mounting plate 114 are define on a same plane, and the bumps 124 of the first and the second insulative member 1201, 1211 are arranged in a row after the first insulative member 1201 is engaged with the second insulative member 1211. In the present embodiment, the first insulative member 1201 and the second insulative member 1211 are of a same structure, thus, the number of parts of the plug connector assembly 100 can be reduced and the plug connector assembly 100 can be easy to be assembled, so that the production cost of the plug connector assembly 100 can be reduced.

The metal case 13 surrounds the insulative housing 11, exposing the mating surface 110 and the mounting surface 111 to outside thereof. The metal case 13 defines a pair of through holes 130 spaced on a same side. The latching members 4 are a pair and spaced mounted on the insulative housing 11. Each of the latching member 4 includes a mounting portion 40 forwardly extending, a connecting portion 41 upwardly extending from a rear end of the mounting portion 40, an elastic portion 42 forwardly extending from a top end of the connecting portion 41 and a locking portion 43 disposed on an extremity end of the elastic portion 42. The mounting portion 40 defines a stopping portion 400 downwardly extending there from to limit the depth of the latching member 4 inserted into the insulative housing 11. The elastic portion 420 defines a pressing portion 420 upwardly extending there from, and a holding portion 421 deposed on a front side of the pressing portion 420 and downwardly extending from the pressing portion 420. The holding portion 421 is used for preventing the elastic portion 42 from being overly pressed downwardly. The locking portions 43 are exposed through the corresponding through holes 130 of the metal case 13 to latch with the mating connector.

The outer case 5 includes a first case 51 and a second case 52 engaging with the first case 51 by snap-in way. The outer case 5 defines an operating portion 50 for operating the pressing portion 420 of the latching member 4. Operators presses the operating portion 50 to press the pressing portion 420, and then the pressing portion 420 further drives the locking portion 43 to move toward the inside of the insulative housing 11, and than disengages the latching with the mating connector. The operating portion 50 and the locking portion 43 are disposed on a same side of the mating member 1.

Compared to the prior art, the first insulative member 1201 and the second insulative member 1211 of the plug connector assembly 100 of the present invention are interference engaged with each other to form an integrate assembly and than assembled on the insulative housing 11, thus the first insulative member 1201 and the second insulative member 1211 can be mounted to the insulating housing 11 in a single alignment so that the assembling process is simple and the production cost is reduced.

What is claimed is:

1. A plug connector assembly comprising:

a cable; and a mating member electrically connected to the cable, the mating member including an insulative housing and a contacting module retained in the insulative housing, the insulative housing including:

a mating surface defined on a front end thereof;

an opposite mounting surface;

a mating slot inwardly extending from the mating surface, and further including a plurality of first contacting slots arranged on a side thereof and a plurality of second contacting slots arranged on another side thereof; and a mounting slot communicating with the mating slot and inwardly extending from the mounting surface for inserting the contacting module, the contacting module including:

a first contacting module and a second contacting module, the first contacting module including a plurality of first contacts arranged along a lateral direction and a first insulative member retaining the first contacts, the second contacting module including a plurality of second contacts arranged along the lateral direction and a second insulative member retaining the second contacts; wherein each of the first and second insulative members includes a same engagement structure, through which the first insulative member and the second insulative member are assembled into a whole by interference arrangement and then inserted into the insulative housing together; wherein both the first insulative member and the second insulative member are of a same structure.

2. The plug connector assembly as claimed in claim 1, wherein the engagement structure includes a mounting projection and a mounting hollow, and the mounting projection disposed on the first insulative member is interference inserted into the corresponding mounting hollow disposed on the second insulative member, and the mounting projection disposed on the second insulative member is interference inserted into the corresponding mounting hollow disposed on the first insulative member.

3. The plug connector assembly as claimed in claim 2, wherein the mounting projection and the mounting hollow are connected with each other.

4. The plug connector assembly as claimed in claim 1, wherein the insulative housing further includes a mounting plate rearwardly extending from the mounting surface in a horizontal plane, the mounting plate including a plurality of engagement slots, each of the first insulative member and the second insulative member includes a plurality of bumps interference inserted into the corresponding engagement slots to fix the contacting module to the insulative housing.

5. The plug connector assembly as claimed in claim 4, wherein the engagement slots are arranged on a same plane, and the bumps are arranged in a same line after the first insulative member are arranged with the second insulative member.

6. The plug connector assembly as claimed in claim 1, wherein the first contacting module has same structure as the second contacting module.

7. The plug connector assembly as claimed in claim 1, wherein the mating member includes a metal case enclosing the insulative housing.

8. The plug connector assembly as claimed in claim 1, further including an outer case enclosing the mating connector and the cable.

9. The plug connector assembly as claimed in claim 8, further including a pair of latching members assembled on the insulative housing for latching with a mating connector.

10. The plug connector assembly as claimed in claim 9, wherein the outer case includes an operating portion for operating the latching members to disengage from the mating connector.

11. The plug connector assembly as claimed in claim 1, wherein the mounting slot is composed of a plurality of units spaced from one another to allow the first contacts and the second contacts to extend therethrough into the mating slot.

12. An electrical connector comprising:

a mating member including an insulative housing and a contact module retained in the housing;

a mating slot formed in a front portion of the housing;

a mounting slot formed in a rear portion of the housing opposite to the mating slot in a front-to-back direction;

the contact module including a first contact module and a second contact module assembled to each other in a vertical direction perpendicular to the front-to-back direction, said first contact module including a plurality of first contacts retained in a first insulative member, and said second contact module including a plurality of contacts retained in a second insulative member; and a mounting plate formed around the mounting slot of the housing and extending in a horizontal plane; wherein the mounting plate is sandwiched between the first insulative member of the first contact module and the second insulative member of the second contact module in the vertical direction.

13. The electrical connector as claimed in claim 12, wherein the mounting plate forms a plurality of engagement slots, and both said first insulative member and said second insulative member forms a plurality of bumps received within the corresponding engagement slots, respectively.

14. The electrical connector as claimed in claim 12, wherein said first insulative member and said second insulative member are of a same structure in an opposite manner.

15. The electrical connector as claimed in claim 12, wherein the mounting slot is composed of a plurality of units spaced from one another to allow the first contacts and the second contacts to extend therethrough into the mating slot along the front-to-back direction.

16. The electrical connector as claimed in claim 12, wherein each of the first insulative member and the second insulative member forms both mounting projections and mounting hollows to receive the corresponding mounting projections, and the mounting projection of the first insulative member abuts against the mounting projection of the second insulative member in a transverse direction perpendicular to both said vertical direction and said front-to-back direction.

17. An electrical connector comprising:

a mating member including an insulative housing and a contact module retained in the housing;

a mating slot formed in a front portion of the housing;

a mounting slot formed in a rear portion of the housing opposite to the mating slot in a front-to-back direction; and the contact module including a first contact module and a second contact module assembled to each other in a vertical direction perpendicular to the front-to-back direction, said first contact module including a plurality of first contacts retained in a first insulative member, and said second contact module including a plurality of contacts retained in a second insulative member; wherein said first contact module and said second contact module are structurally same with each other in an opposite manner.

18. The electrical connector as claimed in claim 17, wherein each of said first insulative member and said second insulative member has first means for engagement with each other and second means for engagement with the housing.

19. The electrical connector as claimed in claim 18, wherein said housing further includes a mounting plate extending in a horizontal plane, to which the second means is engaged.

20. The electrical connector as claimed in claim 18, wherein the first means on the first insulative member is intimately located beside the first means on the second insulative member in a transverse direction perpendicular to both the front-to-back direction and the vertical direction.

* * * * *